United States Patent [19]

Likins, Jr.

[11] Patent Number: 4,815,965

[45] Date of Patent: Mar. 28, 1989

[54] MONITORING AND CONTROL OF A FURNACE

[75] Inventor: Merle R. Likins, Jr., Bartlesville, Okla.

[73] Assignee: Applied Automation, Inc., Bartlesville, Okla.

[21] Appl. No.: 493,851

[22] Filed: May 12, 1983

[51] Int. Cl.[4] ..... F23N 5/00

[52] U.S. Cl. ..... 431/12; 431/76; 431/75

[58] Field of Search ..... 431/75, 76, 12, 13; 236/15 E

[56] References Cited

U.S. PATENT DOCUMENTS

| | | | |
|---|---|---|---|
| 3,153,587 | 10/1964 | Schuerger | 431/76 |
| 3,993,447 | 11/1976 | Buss et al. | 236/15 E |
| 4,138,725 | 2/1979 | Ikemoto et al. | 431/76 |
| 4,174,943 | 11/1979 | Reed | 431/76 |
| 4,187,542 | 2/1980 | Ball et al. | 236/15 E |
| 4,330,261 | 5/1982 | Sun | 236/15 E |
| 4,362,499 | 12/1982 | Nethery | 431/12 |
| 4,408,569 | 10/1983 | Novak | 122/448 R |

FOREIGN PATENT DOCUMENTS

| | | | |
|---|---|---|---|
| 0131623 | 10/1980 | Japan | 431/76 |
| 1562536 | 3/1980 | United Kingdom | 431/76 |
| 2036290 | 6/1980 | United Kingdom | 431/76 |

OTHER PUBLICATIONS

Allen et al., *Heat Engines*, McGraw-Hill Book Co., Inc. Third Ed., pp. 140–146, 1925.

Robertson, J. L.; 'The Application of Microprocessors to Process Control-Paper No. 11; England, BNF, Metals Technology Centre (Sep. 1977).

*Primary Examiner*—Carroll B. Dority, Jr.

*Attorney, Agent, or Firm*—Laney, Dougherty, Hessin & Beavers

[57] ABSTRACT

The efficiency of a furnace is determined by determining the percentage of the heat supplied to the furnace in the form of fuel which is lost due to a plurality of phenomena in the furnace operation. The thus determined efficiency may be displayed for use by an operator or may be utilized for automatic control of the furnace so as to substantially maximize the efficiency of the furnace.

16 Claims, 2 Drawing Sheets

MONITORING AND CONTROL OF A FURNACE

Figure 1:
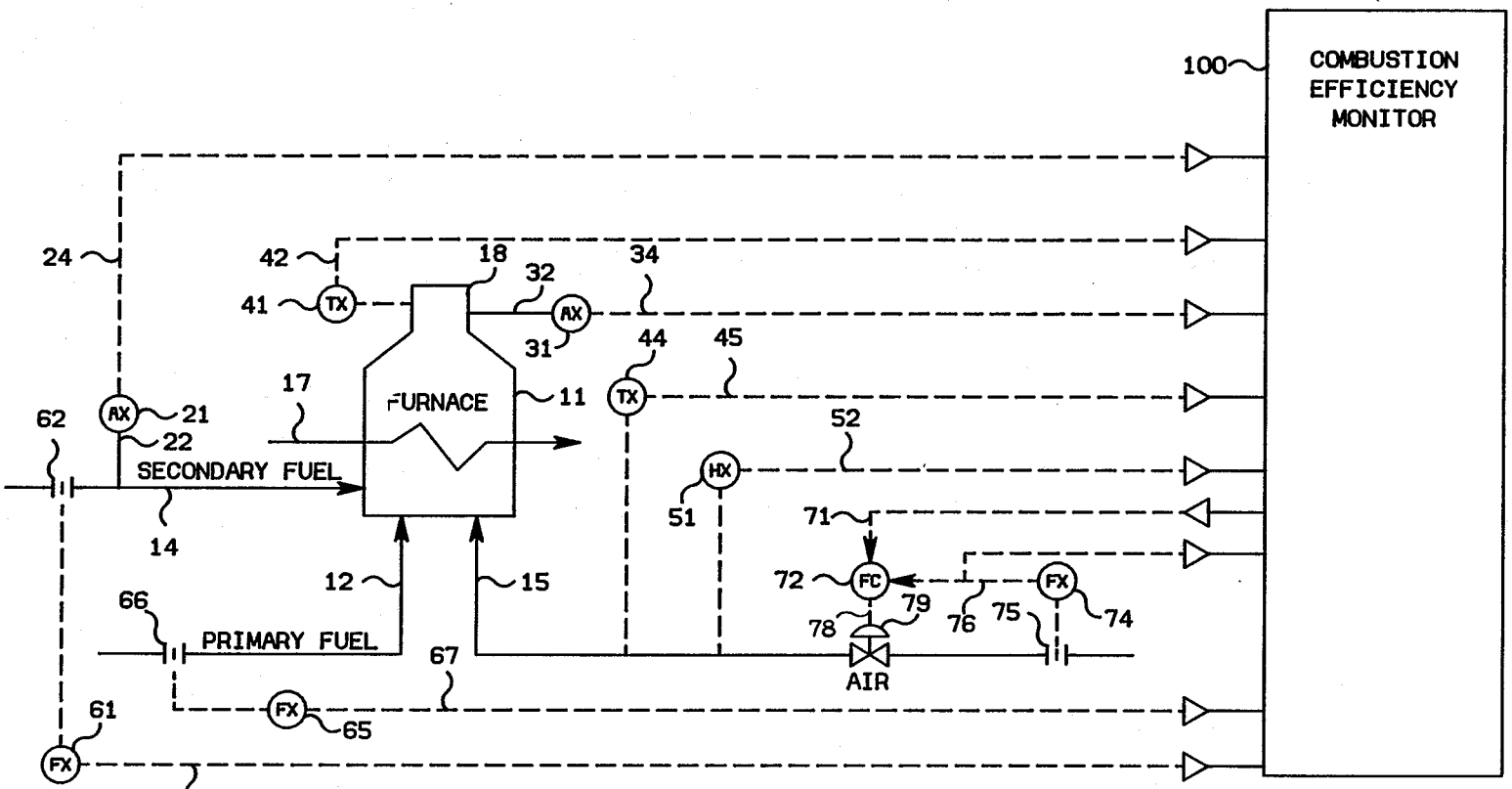

This invention relates to the monitoring and control of a furnace. In one aspect this invention relates to method and apparatus for monitoring the efficiency of a furnace. In another aspect this invention relates to method and apparatus for substantially maximizing the efficiency of a furnace.

Furnaces are utilized in many processes to supply heat. This heat may be utilized in a large variety of ways such as supplying heat to process streams, producing steam or other heating fluids, etc.

A fuel is typically provided to the furnace with the combustion of such fuel supplying heat. The ratio between the heat actually utilized, such as the heat absorbed by a process stream, and the heat supplied in the form of fuel to the furnace is typically referred to as the "efficiency" of the furnace. It is desirable to maximize the efficiency of a furnace to the extent possible to avoid wasting costly fuel.

In the past it has been believed that in order to operate a combustion process efficiently, the combustion components (oxygen and fuel) must be supplied in proportions which allow complete combustion without a substantial excess of free oxygen in the combustion products. Thus, the oxygen concentration in the flue gas was a variable which was typically manipulated to control the efficiency of the furnace. However, it has been found that complete combustion does not necessarily result in a maximum efficiency and that, in some cases, it is even desirable to have some unburned fuel for maximum efficiency. Thus, it is an object of this invention to provide method and apparatus for actually determining the efficiency of a combustion process without relying on the assumption that complete combustion without a substantial excess of free oxygen results in maximum efficiency. Also, it is another object of this invention to provide method and apparatus for substantially maximizing the efficiency of a combustion process by actually determining the efficiency of the combustion process and controlling the combustion process so as to maximize the thus determined efficiency.

In accordance with the present invention, method and apparatus is provided whereby heat losses due to a plurality of phenomena in a furnace operation are determined. The heat losses are summed to give an indication of the actual efficiency of the furnace. The thus determined actual efficiency may be displayed for an operator or may be utilized to directly control the furnace so as to substantially maximize the efficiency of the furnace.

The heat losses which occur in a furnace operation in which a fuel and oxygen (air is the typical source of oxygen) are combusted with the combustion product being exhausted through a stack are as follows:

1. Dry air has energy (heat) that goes up the stack. Some fuel supplied this energy.

2. Water in the fuel passes through the furnace and is heated. Some fuel is required to supply this heat.

3. Water created in the combustion process has heat which is a loss.

4. When burning coal or similar materials, hot, solid incombustible material removed plus some percentage of the carbon that did not burn is a loss.

5. There is typically a small radiation loss from the furnace.

6. There may be losses which are unmeasurable but are generally known to process operators.

7. Moisture in the air utilized to supply oxygen is heated up. This moisture passes through the furnace and results in a heat loss.

Typically, losses 1 and 3 will be highest and also loss 7 may substantially reduce the efficiency depending upon the humidity of the air. In the case of coal or similar fuels, loss 4 may also be significant. Loss 2 may be significant if the fuel contains any significant water content. Losses 5 and 6 will typically be very small.

In accordance with the present invention, the efficiency of the furnace is determined by determining the percentage of the heat supplied to the furnace in the form of fuel which is lost through at least the most relevant of the above-listed losses. The thus determined percentage losses are summed and can be subtracted from 100 percent to give the actual efficiency of the furnace.

Figure 2:
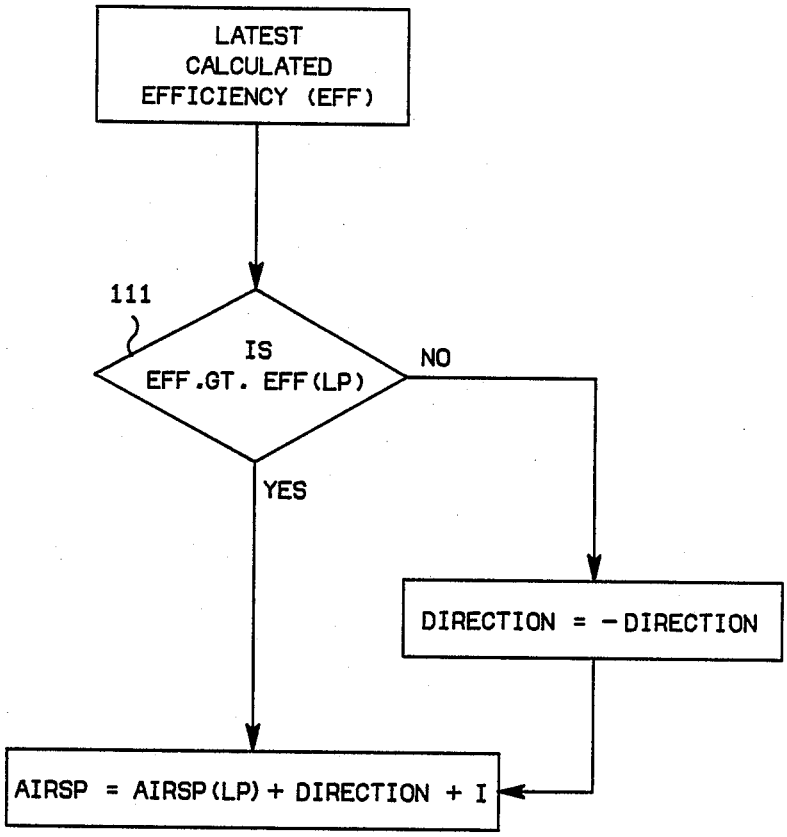

Other objects and advantages of the invention will be apparent from the foregoing brief description of the invention and the claims as well as the detailed description of the drawings which are briefly described as follows:

FIG. 1 is a diagrammatic illustration of a furnace and the associated monitoring and control system of the present invention; and FIG. 2 is a flow diagram of the logic utilized to calculate the setpoint for the air flow rate to the furnance illustrated in FIG. 1 based the process measurements illustrated in FIG. 1.

The invention is illustrated and described in terms of a single furnace to which both a primary fuel and a secondary fuel are provided. However, the invention is applicable to different furnace configurations and is applicable to a furnace in which only a single fuel is utilized.

A specific system configuration is set forth in FIG. 1 for the sake of illustration. However, the invention extends to different types of system configurations which accomplish the purpose of the invention. Lines designated as signal lines in the drawings are electrical or pneumatic in this preferred embodiment. Generally, the signals provided from any transducer are electrical in form. However, the signals provided from flow sensors will generally be pneumatic in form. Transducing of these signals is not illustrated for the sake of simplicity because it is well known in the art that if a flow is measured in pneumatic form it must be transduced to electrical form if it is to be transmitted in electrical form by a flow transducer. Also, transducing of the signals from analog form to digital form or from digital form to analog form is not illustrated because such transducing is also well known in the art.

The invention is also applicable to mechanical, hydraulic or othe signal means for transmitting information. In almost all monitoring or control systems some combination of electrical, pneumatic, machanical or hydraulic signals will be used. However, use of any other type of signal transmission, compatible with the process and equipment in use, is within the scope of the invention.

A process chromatograph system, Optichrom ®2100, manufactured by Applied Automation, Inc. is used in the preferred embodiment of this invention to calculate the losses and efficiency based on measured process parameters as well as set points supplied thereto. Other such systems could also be used in the invention.

Referring now to FIG. 1, there is illustrated a furnace 11 to which a primary fuel is supplied through conduit means 12, a secondary fuel is supplied through conduit means 14 and air is supplied through conduit means 15. Typically, the primary fuel would be natural gas while the secondary fuel would be an off-gas or waste gas having some combustible hydrocarbon content. Heat from the combustion of the primary fuel, secondary fuel and air may be utilized for any desired purpose such as heating the fluid in the process stream flowing through conduit means 17. Gases from the combustion process are exhausted through the stack 18.

The analyzer transducer 21 is a chromatographic analyzer capable of analyzing for a number of components in the secondary fuel. The analyzer transducer 21 may be an Optichrom®2100 chromatographic analyzer manufactured by Applied Automation, Inc., Bartlesville, Okla. A sample of the secondary fuel flowing through conduit means 14 is provided to the analyzer transducer 21 through conduit means 22. The analyzer transducer 21 analyzes the secondary fuel and provides an output signal 24 which is representative of such analysis. In operation, signal 24 is preferably utilized to provide information concerning the mole percent of 25 components in the secondary fuel. Signal 24 is provided from the analyzer transducer 21 as an input to the combustion efficiency monitor 100.

A listing of the 25 components which are included in the analysis of the secondary fuel is set forth in Table I. Also other information for these components which will be used in the calculations described hereinafter is set forth in Table I. Symbols used in Table I are defined as follows:

HCMBG=pure component gross heat of combustion, BTU/cu ft.

HCMBN=pure component net heat of combustion, BTU/cu ft.

FMW=pure component molecular weight

CMOLS=moles carbon/moles pure component

H2MOLS=moles hydrogen/moles pure component

TABLE I

| No. | Component | HCMBG | HCMBN | FMW | CMOLS | H2MOLS |
|---|---|---|---|---|---|---|
| 1 | Methane | 1011.6 | 910.77 | 16.04 | 1 | 2 |
| 2 | Ethane | 1783.7 | 1631.50 | 30.07 | 2 | 3 |
| 3 | Propane | 2563.3 | 2358.30 | 44.10 | 3 | 4 |
| 4 | n-Butane | 3374.4 | 3114.20 | 58.12 | 4 | 5 |
| 5 | iso-butane | 3352.15 | 3092.90 | 58.12 | 4 | 5 |
| 6 | n-pentane | 4249.10 | 3929.30 | 72.15 | 5 | 6 |
| 7 | iso-pentane | 4218.7 | 3900.25 | 72.15 | 5 | 6 |
| 8 | neo-pentane | 4197.0 | 3879.0 | 72.15 | 5 | 6 |
| 9 | n-hexane | 4250.0 | 3950.0 | 86.18 | 6 | 7 |
| 10 | ethylene | 1608.5 | 1507.3 | 28.05 | 2 | 2 |
| 11 | propylene | 2371.7 | 2218.3 | 42.08 | 3 | 3 |
| 12 | n-butene-1 | 3177.9 | 2970.3 | 56.11 | 4 | 4 |
| 13 | iso-butene | 3156.0 | 2949.0 | 56.11 | 4 | 4 |
| 14 | pentene-1 | 4028.5 | 3763.5 | 70.13 | 5 | 5 |
| 15 | cis-pentene-2 | 4064.0 | 3796.0 | 70.13 | 5 | 5 |
| 16 | transpentene-2 | 4058.0 | 3790.0 | 70.13 | 5 | 5 |
| 17 | n-heptane | 4250.0 | 3950.0 | 100.21 | 7 | 8 |
| 18 | carbon monoxide | 3226.0 | 341.0 | 28.01 | 1 | 0 |
| 19 | carbon dioxide | 0 | 0 | 44.01 | 0 | 0 |
| 20 | hydrogen | 324.0 | 273.0 | 2.02 | 0 | 1 |
| 21 | hydrogen sulfide | 672.0 | 621.0 | 34.08 | 0 | 1 |
| 22 | nitrogen | 0 | 0 | 28.01 | 0 | 0 |
| 23 | helium | 0 | 0 | 4.00 | 0 | 0 |
| 24 | oxygen | 0 | 0 | 32.00 | 0 | 0 |
| 25 | water | 0 | 0 | 18.02 | 0 | 0 |

It is noted that an analysis of the primary fuel could be utilized if desired. However, the composition of the primary fuel will generally be substantially constant and known. This known composition is used in place of an analysis.

Hereinafter, the primary fuel and secondary fuel will be considered as a single fuel for the sake of simplicity. The concentration of any component in this single fuel (mol component/mol single fuel) will be determined by adding the known concentration of the component in the primary fuel to the concentration of the component in the secondary fuel as determined by analysis.

The analyzer transducer 31 is also a chromatographic analyzer, such as the Optichrom®2100 chromatographic analyzer system, which is capable of analyzing the flue gas to determine the mole percent of various components of the flue gas. A sample of the flue gas is provided to the analyzer transducer 31 through conduit means 32. The analyzer transducer 31 analyzes the flue gas and provides an output signal 34 which is representative of such analysis. In operation, the analyzer transducer 31 is preferably utilized to determine the mole percent of six components in the stack gas. Signal 34 is provided from the analyzer transducer 31 as an input to the combustion efficiency monitor 100.

A listing of the 6 components which are included in the analysis of the stack gas and the molecular weight of these components is set forth in Table II. The SGAS symbol is used in the calculations which follow as the concentration of the particular components (mols component/mol stack gas).

TABLE II

| No. | Component | Molecular Weight |
|---|---|---|
| SGAS (1) | Carbon Monoxide | 28 |
| SGAS (2) | Carbon Dioxide | 44 |
| SGAS (3) | Oxygen | 32 |
| SGAS (4) | Nitrogen | 28 |
| SGAS (5) | Argon | 40 |
| SGAS (6) | Water | 18 |

It is noted that the concentration of argon will generally be ignored or lumped with some other component such as nitrogen since the concentration of argon will be very low.

Temperature transducer 41 in combination with a temperature sensing device such as a thermocouple, which is operably located in the stack 18, provides an output signal 42 which is representative of the actual temperature of the flue gases. Signal 42 is provided from the temperature transducer 41 as an input to the combustion efficiency monitor 100.

In like manner, temperature transducer 44 in combination with a temperature sensing device such as a thermocouple, which is operably located in conduit means 15, provides an output signal 45 which is representative of the actual temperature of the air flowing through conduit means 15. Signal 45 is provided from the temperature transducer 44 as an input to the combustion efficiency monitor 100.

The humidity transducer 51, in combination with a humidity sensing device, which is operably located in conduit means 15, provides an output signal 52 which is representative of the water content of the air (lbs. $H_2O$/lbs. dry air). Signal 52 is provided from the humidity transducer 51 as an input to the combustion efficiency monitor 100. The humidity sensing system may be a psychrometer or hygrometer, manufactured by the Bendix Corporation, Environmental Science Division.

Flow transducer 61 in combination with the flow sensor 62, which is operably located in conduit means 14, provides an output signal 64 which is representative of the actual flow rate of the secondary fuel through conduit means 14. Signal 64 is provided from the flow transducer 61 as an input to the combustion efficiency monitor 100.

The flow transducer 65 in combination with the flow sensor 66, which is operably located in conduit means 12, provides an output signal 67 which is representative of the actual flow rate of the primary fuel through conduit means 12. Signal 67 is provided from the flow transducer 65 as an input to the combustion efficiency monitor 100.

Flow transducer 74 in combination with the flow sensor 75, which is operably located in conduit means 15, provides an output signal 76 which is representative of the actual flow rate of air through conduit means 15. Signal 76 is provided from the flow transducer 74 as the process variable input to the flow controller 72 and as an input to the combustion efficiency monitor 100.

In response to the described input signals, various losses associated with the operation of the furnace 11 are determined by the combustion efficiency monitor 100 as is the efficiency of the furnace 11. These losses and the efficiency of the furnace may be displayed for an operator. Also, as will be more fully described hereinafter, the combustion efficiency monitor may be utilized to establish signal 71, which is representative of the desired flow rate of air to the furnace 11, based on the calculated efficiency. Signal 71 may be utilized to substantially maximize the efficiency of the furnace 11 since signal 71 is based on the actual efficiency of the furnace 11.

If utilized, the signal 71 is provided from the combustion efficiency monitor 100 as the set point input to the flow controller 72.

In response to signals 71 and 76, the flow controller 72 provides an output signal 78 which is responsive to the difference between signals 71 and 76. Signal 78 is scaled in a conventional manner so as to be representative of the position of the control valve 79, which is operably located in conduit means 15, required to maintain the actual flow rate of the air substantially equal to the flow rate represented by signal 71. Signal 78 is provided from the flow controller 72 as a control signal to the control valve 79 and the control valve 79 is manipulated in response thereto.

The actual losses which have been previously listed are calculated by the combustion efficiency monitor 100 as follows:

The percentage of the heat provided to the furnace in the form of fuel which is lost as hot dry air (LOSS1) is given by Equation (1).

$$LOSSI=(C_P \times DRYGAS \times (T(2)-T(1)))/HEATIN \quad (1)$$

where $C_P$=specific heat of the dry air;

DRYGAS=the number of pounds of dry air produced per pound of fuel supplied to the furnace;

T(2)=the flue gas temperature measured in °F. (signal 42);

T(1)=the supplied air temperature measured in °F. (signal 45); and

HEATIN=the number of BTU's which may be provided by the combustion of each pound of fuel.

$C_P$ is known to be 0.24 BTU/lb.°F. and T(2) and T(1) are measured. The value of the term DRYGAS is given by Equation (2).

$$DRYGAS=(MOLDRYGAS=CFUEL)/CDRYGAS \quad (2)$$

where

MOLDRYGAS=the molecular weight of the DRYGAS flowing through the stack;

CFUEL=the number of pounds of carbon or carbon equivalents (generally sulfur) per pound of fuel supplied to the furnace; and CDRYGAS=the number of pounds of carbon per mole of DRYGAS removed through the stack.

For the previously described stack gas analysis, MOLDRYGAS is given by Equation (3).

$$MOLDRYGAS=28 \times SGAS(1)+44 \times SGAS(2)+32 \times SGAS(3)+28 \times SGAS(4) \quad (3)$$

The concentration of argon may be ignored because it is small.

CFUEL is given by Equation (4).

$$CFUEL=XC+(XS/2.67) \quad (4)$$

where XC is the pounds of carbon per pound of fuel (determined from analysis and known carbon content of primary fuel) and XS is the pounds of sulfur per pound of fuel (again determined by analysis and known sulfur content of primary fuel). The term 2.67 is the molecular weight of sulfur divided by the molecular weight of carbon.

CDRYGAS is given by Equation (5).

$$CDRYGAS=12(SGAS(1)+SGAS(2)) \quad (5)$$

The amount of heat supplied per pound of fuel will be determined by a laboratory analysis for a solid or liquid fuel or may be known for a gaseous fuel whose composition does not change. However, it is preferred to calculate the number of BTU's provided by each pound of fuel in the present case because of the presence of the secondary fuel whose composition may vary widely. The term HEATIN can be calculated in accordance with Equation (6).

$$HEATIN = 379 \times HVG/FUELMW \quad (6)$$

where HFG is the heating value of the fuel and FUELMW is the molecular weight of the fuel. The constant 379 is the number of cubic feet of gas in a standard mole. Both HVG and FUELMW are determined from the secondary fuel analysis and known composition of the primary fuel. HVG is determined in accordance with Equation (7), $$HVG = \Sigma XMOL(I) \times HCMBG(I)/100 \quad (7),$$

while FUELMW is determined in accordance with Equation (8).

$$FUELMW = \Sigma XMOL(I) \times FMW(I)/100. \quad (8)$$

XMOL is again the concentration of a component in both the primary fuel and the secondary fuel which is determined as previously described. The term (I) refers to the use of a DO LOOP which goes through the 25 components listed in Table I. HCMBG and FMW are as given in Table I.

The percentage heat loss due to moisture in the fuel (LOSS2) is given by Equation (9).

$$LOSS2 = XH20 \times (HH20V - HH20L)/HEATIN \quad (9)$$

where

XH20 = pounds of water per pound of fuel as determined from the analysis and known composition of the primary fuel;

HH20V = the enthalpy of the water (which will be steam) as it leaves the stack;

HH20L = the enthalpy of the water in the air supplied to the furnace; and

HEATIN is as previously defined.

HH20V is given by Equation (10), $$HH20V = 1054.4 + (0.458 \times T(2)) \quad (10)$$

while HH20L is given by Equation (11).

$$HH20L = T(1) - 32.0 \quad (11)$$

T(2) and T(1) are as previously defined.

The percentage loss due to water formed from the combustion of the fuel and oxygen (LOSS 3) is given by Equation (12).

$$LOSS3 = [9 \times XH \times (HH20V - HH20L)]/HEATIN \quad (12)$$

where

XH = the pounds of hydrogen contained in each pound of fuel (determined from analysis of secondary fuel and known composition of the primary fuel); and HH20V, HH20L and HEATIN are as previously defined.

The constant 9 is the number of pounds of water which is formed from each pound of hydrogen.

The percentage loss due to refuse (LOSS4) is relevant only when a fuel such as oil or coal is utilized. In the present case, loss 4 would be 0 since the fuel is a gas. However, LOSS4 can be calculated by determining the pounds of refuse which are formed from each pound of fuel and multiplying this term by the number of BTU's lost for each pound of refuse. The result is divided by HEATIN to give LOSS4.

The percentage loss due to radiation (LOSS5) is typically small and would not generally be utilized to calculate efficiency. However, if it is desired to use the radiation loss in the efficiency calculation, the radiation loss would typically be provided by an operator based on operating experience. The percentage loss would be the amount of heat loss due to radiation divided by the term HEATIN.

Other unmeasured losses (referred to as LOSS6) are generally not used but, if an operator is aware of specific other losses, these losses can be entered.

The percentage loss due to moisture in the air (LOSS7) is given by Equation (13).

$$LOSS7 = 0.445(XHUM) \times (ACTAIR) \times (T(2) - T(1))/HEATIN \quad (13)$$

where

XHUM = pounds of water per pound of air (signal 52);

ACTAIR is the actual flow rate of the air through conduit means 15 (signal 76); and T(2), T(1) and HEATIN are as previously defined.

It is noted that, in some cases, it may be difficult to measure the actual flow rate of the air because of the large diameter of pipes used to supply air to a furnace. In those cases, the actual flow rate of the air can be calculated by first calculating the theoretical amount of air required for complete combustion based on the composition of the fuel. A stack analysis is then utilized to determine the percent excess air. As an example, if there is 10% excess air, the theoretical air may be multiplied by 1.1 to determine the actual flow rate of the air.

The efficiency (EFF) of the furnace 11 is determined by summing the seven described losses (which were determined) and subtracting the result from 100.0.

EXAMPLE

In the following example, the primary fuel supply was natural gas with an essentially fixed composition. The secondary fuel supply used was off-gas from an ethylene recovery unit of a polyethylene plant. In these examples, the secondary fuel composition was also essentially constant but considerably different from that of the primary fuel. The composition of the primary fuel and the secondary fuel are set forth in Table III as is other relevant information.

TABLE III

| No. | Component | Fuel Gas (mol pct) | Off-Gas (mol pct) |
|---|---|---|---|
| 1 | $CH_4$ | 95.66 | 3.43 |
| 2 | $C_2$ | 3.01 | 1.00 |
| 3 | $C_3$ | 0.57 | 0.13 |
| 4 | $NC_4$ | 0.09 | 0.30 |
| 5 | $IC_4$ | 0.10 | 6.67 |
| 6 | $NC_5$ | 0.03 | 0.00 |
| 7 | $IC_5$ | 0.04 | 0.89 |
| 8 | $NEC_5$ | 0.00 | 0.00 |
| 9 | $NC_6$ | 0.00 | 0.00 |
| 10 | $C_2^=$ | 0.00 | 37.48 |
| 11 | $C_3$ | 0.00 | 0.19 |
| 12 | $NC_4^=$ | 0.00 | 0.20 |
| 13 | $IC_4^=$ | 0.00 | 0.00 |
| 14 | $IC_5^=$ | 0.00 | 0.00 |
| 15 | $CC_5^=$ | 0.00 | 0.00 |
| 16 | $TC_5^=$ | 0.00 | 0.00 |
| 17 | $NC_7$ | 0.00 | 0.00 |

TABLE III-continued

| No. | Component | Fuel Gas (mol pct) | Off-Gas (mol pct) |
|---|---|---|---|
| 18 | CO | 0.00 | 0.00 |
| 19 | $CO_2$ | 0.44 | 0.03 |
| 20 | $H_2$ | 0.00 | 3.49 |
| 21 | $H_2S$ | 0.00 | 0.00 |
| 22 | $N_2$ | 0.00 | 45.97 |
| 23 | HE | 0.00 | 0.00 |
| 24 | $O_2$ | 0.00 | 0.22 |
| 25 | $H_2O$ | 0.00 | 0.00 |
| Mole Wgt | | 16.85 | 29.34 |
| Gross Heating Value | | 1045.35 | 952.16 |
| Net Heating Value | | 942.43 | 885.59 |

In the first test, the stack gas composition was set forth in Table IV.

TABLE IV

| Stack Composition | |
|---|---|
| Component | Concentration (Mol Pct) |
| CO | 0.00 |
| $CO_2$ | 11.43 |
| $O_2$ | 0.85 |
| $N_2$ | 86.68 |
| AR | 1.04 |
| $H_2O$ | 0.00 |

For the fuel compositions set forth in Table III and the stack gas compositions set forth in Table IV, as well as the other relevant major parameters previously described, the calculated results were as follows:

| | |
|---|---|
| LB Combustible Carbon/lb fuel (XC) | 0.74399 |
| LB Hydrogen/lb fuel (XH) | 0.24206 |
| LB Sulfur/lb fuel (XS) | 0.00000 |
| Fuel Mole wgt. (FUELMW) | 16.85500 |
| Fuel gross Heating Value (HVG) | 1045.34766 |
| Heat Input/lb fuel (HEATIN) | 23505.60 |
| Dry Gas/lb fuel (DRYGAS) | 16.19984 |
| Exit Gas Temp ($T_2$) | 358.51587 |
| Actual Air (ACTAIR) | 17.49734 |
| Dry Air Loss (LOSS1) | 4.71651-LOSS 1 |
| $H_2$ in Fuel Loss (LOSS2) | 0.00000-Loss 2 |
| Combustion $H_2O$ Loss (LOSS3) | 10.91101-Loss 3 |
| Refuse Loss (LOSS4) | 0.00000-Loss 4 |
| Radiation Loss (LOSS5) | 0.00000-Loss 5 |
| Unmeasured Loss (LOSS6) | 0.00000-Loss 6 |
| $H_2O$ in Air Loss (LOSS7) | 0.00000-Loss 7 |
| Total Heat Loss | 15.62751 |
| Efficiency (EFF) | 84.37248 |

As has been previously stated, there is no refuse loss when gas is used as the fuel. Also, the radiation loss and unmeasured loss were not used. Also, there was no water in the fuel so that too was zero. It was believed that there was water in the air and that there would have been some loss attritutable to the water in the air but LOSS7 was not determined.

In a second test, the fuel was the same as set forth in Table III but the stack composition had changed as set forth in Table V.

TABLE V

| STACK COMPOSITION | |
|---|---|
| Component | Concentration (Mol pct) |
| CO | 0.00 |
| $CO_2$ | 11.67 |
| $O_2$ | 0.42 |
| $N_2$ | 86.87 |
| AR | 1.04 |

TABLE V-continued

| STACK COMPOSITION | |
|---|---|
| Component | Concentration (Mol pct) |
| $H_2O$ | 0.00 |

From the analyses set forth in Table V and the other relevant measured factors, the results were as follows:

| | |
|---|---|
| Lb Combustible Carbon/lb Fuel (XC) | 0.74399 |
| Lb Hydrogen/Lb Fuel (XH) | 0.24206 |
| Lb Sulfur/Lb Fuel (XS) | 0.00000 |
| Fuel Mole Wgt. (FUELMW) | 16.84400 |
| Fuel Gross Heating Value (HVG) | 1045.34766 |
| Heat Input/Lb Fuel (HEATIN) | 23505.60 |
| Dry Gas/Lb Fuel (DRYGAS) | 15.87474 |
| Exit Gas Temp (T(2)) | 363.83643 |
| Actual Air (ACTAIR) | 17.17262 |
| Dry Air Loss (Loss1) | 4.71768 |
| $H_2O$ in Fuel Loss (Loss2) | 0.00000 |
| Combustion $H_2O$ Loss (Loss3) | 10.93907 |
| Refuse Loss (Loss4) | 0.00000 |
| Radiation Loss (Loss5) | 0.00000 |
| Unmeasured Loss (Loss6) | 0.00000 |
| $H_2O$ in Air Loss (Loss7) | 0.00000 |
| Total Heat Loss | 15.65675 |
| Efficiency (EFF) | 84.34325 |

Again, only LOSS1 and LOSS2 were determined. However, it can be seen that, even though the fuel composition did not change, the overall efficiency did change by a small percentage which is attributable to some change in the air supply which resulted in the stack gas composition differences noted in Tables IV and V.

While the losses and efficiency set forth in the results of the examples may be displayed and used by an operator, the calculated efficiency may be utilized for automatic control of the efficiency of the furnace 11 if desired. This may be accomplished as illustrated in FIG. 2.

Referring now to FIG. 2, the latest calculated efficiency is entered into the logic block 111. Also, the efficiency determined in the last pass through the computer and the direction of the last change in air set point are available to logic block 111. The current efficiency is compared to the efficiency of the last pass in the logic block 111.

If the current efficiency is greater than the efficiency of the last pass, then the direction of air set point change is maintained. If the latest calculated efficiency is less than the efficiency for the last pass, then the direction is reversed. Direction is defined to be +1 when the latest air set point is greater then the last set point. Direction is defined to be −1 when the current set point is less than the last set point. A new air set point is now calculated as the air set point plus the product of direction and some incremental value, I. Thus, if air set point increased and efficiency also increased, then air set point will be increased again. If the air set point was increased and efficiency decreased, air set point will be reduced. If air set point was decreased and efficiency increases, then air set point will be decreased again. If air set point was decreased and efficiency decreased, then air set point will be increased.

This technique will search for the maximum efficiency and then move the air flow rate about the point which results in a maximum efficiency for the furnace to thereby substantially maintain the maximum efficiency for the furnace.

In summary, the efficiency of a furnace is determined by determining the heat losses due to a plurality of phenomena in the furnace operation (LOSS 1-LOSS7). LOSS 1 and LOSS3 are by far the most significant heat losses and will always be determined. The other losses will generally be in fractions of a percent. Of the other losses, LOSS2 and LOSS7 are most likely to contribute to the heat loss where the fuel is a gas. LOSS4 is relevant only when a solid fuel is used and LOSS 5 and LOSS6 are seldom relevant. Thus, the efficiency of the furnace is determined basically from LOSS2 and LOSS3. LOSS2 and LOSS7 may be added to the efficiency calculation if desired. LOSS4 will be used only when a fuel is provided and LOSS5 and LOSS6 will seldom be used.

The thus calculated efficiency and various losses may be displayed or utilized in automatic control of the furnace as desired.

The invention has been described in terms of a preferred embodiment as illustrated in FIG. 1. In addition to those components which have been specifically described, other components illustrated in FIG. 1 such as flow sensors 62, 66 and 75; flow transducers 61, 65 and 74; temperature transducers 41 and 44; flow controller 72 and control valve 79 are each well known, commercially available control components such as are described at length in Perry's Chemical Engineering Handbook, 4th Edition, Chapter 22, McGraw Hill.

While the invention has been described in terms of the presently preferred embodiment, reasonable variations and modifications are possible by those skilled in the art and such modifications and variations are within the scope of the described invention and the appended claims.

That which is claimed is:

1. Apparatus comprising:

a furnace;

means for supplying a fuel stream to said furnace;

means for supplying an air stream to said furnace, wherein the combustion of a mixture of said fuel stream and said air stream in said furnace supplies heat;

means for withdrawing the gases which result from the combustion of the mixture of said fuel stream and said air stream (combustion gases) from said furnace;

means for determining the percentage heat loss from dry air in said combustion gases (LOSS1);

means for determining the percentage heat loss from water created in the combustion process (LOSS3);

means for determining the efficiency of said furnace based on LOSS1 and LOSS3; and means for automatically manipulating said air stream to said furnace responsive to said means for determining the efficiency of said furnace based on LOSS1 and LOSS3.

2. Apparatus in accordance with claim 1 wherein said means for determining LOSS1 and LOSS3 comprises:

means for determining the actual temperature of said combustion gases (T2);

means for determining the actual temperature of said air stream (T1);

means for determining the composition of said fuel stream;

means for determining the composition of said combustion gases;

means for determining the heat loss from dry air in said combustion gases based on T2, T1, the composition of said fuel stream and the composition of said combustion gases;

means for determining the heat supplied to the furnace by the combustion of said fuel stream based on the composition of said fuel stream (HEATIN);

means for dividing the heat lost from dry air in said combustion gases by HEATIN to establish LOSS1;

means for determining the loss due to water formed from the combustion of said fuel stream based on the hydrogen content of said fuel stream, which is determined from the composition of said fuel stream, and based on T2 and T1; and means for dividing the loss due to water formed from the combustion of said fuel stream by HEATIN to establish LOSS3.

3. Apparatus in accordance with claim 2 additionally comprising:

means for determining the heat loss due to moisture in said fuel stream based on the water content of said fuel stream, which is determined from the composition of said fuel, and based on T2 and T1; and means for dividing the heat loss due to moisture in said fuel by HEATIN to establish the percentage heat loss due to moisture in said fuel (LOSS2), wherein LOSS2 is also taken into consideration in determining the efficiency of said gas.

4. Apparatus in accordance with claim 3 additionally comprising:

means for determining the actual water content of said air stream (XHUM);

means for determining the actual flow rate of said air stream (ACTAIR);

means for determining the loss due to moisture in said air stream based on T2, T1, XHUM and ACTAIR signals; and means for dividing the loss due to moisture in said air stream by HEATIN to establish the percentage loss due to moisture in said air stream (LOSS7), wherein LOSS7 is also taken into consideration in determining the efficiency of said furnace.

5. Apparatus in accordance with claim 4 wherein the percentage heat loss due to radiation of heat from said furnace (LOSS5) and unmeasured losses which are known to be associated with said furnace (LOSS6) are taken into consideration in determining the efficiency of said furnace.

6. Apparatus in accordance with claim 5 wherein said fuel is a liquid or solid fuel for which a residue is left after combustion and wherein the percentage heat loss due to such residue (LOSS4) is taken into consideration in determining the efficiency of said furnace.

7. Apparatus in accordance with claim 1 wherein said means for automatically manipulating said air stream to said furnace in response to said means for determining the efficiency of said furnace based on LOSS1 and LOSS3, comprises:

a control valve operably located so as to control the flow rate of said air stream;

means for establishing a first signal representative of the desired flow rate of said air stream in response to the calculated efficiency of said furnace;

means for establishing a second signal representative of the actual flow rate of said air stream;

means for comparing said first signal and said second signal and for establishing a third signal which is responsive to the difference between said first signal and said second signal, wherein said third signal is scaled so as to be representative of the position of said control valve required to maintain the actual flow rate of said air stream substantially equal to the desired flow rate represented by said first signal; and means for manipulating said control valve in response to said third signal, wherein the efficiency of said furnace is substantially maximized by manipulating the flow rate of the air stream in response to said third signal.

8. A method for determining the efficiency of a furnace, and for automatically manipulating air flow to said furnace responsive to the determined efficiency, wherein a fuel stream and an air stream are mixed and combusted in said furnace to supply heat and wherein the gases which result from the combustion of the mixture of said fuel stream and said air stream (combustion gases) are removed from said furnace, said method comprising the steps of:

determining the percentage heat loss from dry air in said combustion gases (LOSS1);

determining the percentage heat loss from water created in the combustion process (LOSS3);

determining the efficiency of said furnace based on LOSS1 and LOSS3 and automatically manipulating said air stream responsive to the efficiency of said furnace, wherein the efficiency is determined based on LOSS1 and LOSS3.

9. A method in accordance with claim 8 wherein said steps of determining LOSS1 and LOSS3 comprise:

determining the actual temperature of said combustion gases (T2);

determining the actual temperature of said air stream (T1);

determining the composition of said fuel stream;

determining the composition of said combustion gases;

determining the heat loss from dry air in said combustion gases based on T2, T1, the composition of said fuel stream and the composition of said combustion gases;

determining the heat supplied to the furnace by the combustion of said fuel stream based on the composition of said fuel stream (HEATIN);

dividing the heat loss from dry air in said combustion gases by HEATIN to establish LOSS1;

determining the loss due to water formed from the combustion of said fuel stream based on the hydrogen content of said fuel stream, which is the composition of said fuel stream, and based on T2 and T1; and means for dividing the loss due to water formed from the combustion of said fuel stream by HEATIN to establish LOSS3.

10. A method in accordance with claim 9 additionally comprising the steps of:

determining the heat loss due to moisture in said fuel stream based on the water content of said fuel stream, which is determined from the composition of said fuel, and based on T2 and T1; and dividing the heat loss due to moisture in said fuel by HEATIN to establish the percentage heat loss due to moisure in said fuel (LOSS2), wherein LOSS2 is also taken into consideration in determining the efficiency of said gas.

11. A method in accordance with claim 10 additionally comprising the steps of:

determining the actual water content of said air stream (XHUM);

determining the actual flow rate of said air stream (ACTAIR);

determining the loss due to moisture in said air stream based on T2, T1, XHUM and ACTAIR signals; and dividing the loss due to moisture in said air stream by HEATIN to establish the percentage loss due to moisture in said air stream (LOSS7), wherein LOSS7 is also taken into consideration in determining the efficiency of said furnace.

12. A method in accordance with claim 11 wherein the percentage heat loss due to radiation of heat from said furnace (LOSS5) and unmeasured losses which are known to be associated with said furnace (LOSS6) are taken into consideration in determining the efficiency of said furnace.

13. A method in accordance with claim 12 wherein said fuel is a liquid or solid fuel for which a residue is left after combustion and wherein the percentage heat loss due to such residue (LOSS4) is taken into consideration in determining the efficiency of said furnace.

14. A method in accordance with claim 8 wherein said step for automatically manipulating said air stream comprises:

establishing a first signal representative of the desired flow rate of said air stream in response to the calculated efficiency of said furnace;

establishing a second signal representative of the actual flow rate of said air stream;

comparing said first signal and said second signal and establishing a third signal which is responsive to the difference between said first signal and said second signal, wherein said third signal is scaled so as to be representative of the position of a control valve which is operably located so as to control the flow rate of said air stream, required to maintain the actual flow rate of said air stream substantially equal to the desired flow rate represented by said first signal; and manipulating said control valve in response to said third signal, wherein the efficiency of said furnace is substantially maximized by manipulating the flow rate of the air stream in response to said third signal.

15. Apparatus in accordance with claim 7 wherein said means for establishing said first signal representative of the desired flow rate of said air stream in response to the calculated efficiency of said furnace comprises:

means for establishing an air flow set point signal responsive to the calculated efficiency of said furnace;

means for comparing the current efficiency to the efficiency of the last pass to determine if the current efficiency is greater than or less than the efficiency of the last pass;

means for modifying said air flow set point signal to establish said first signal, wherein said air flow set point signal is incremented or decremented responsive to said means for comparing the current efficiency to the efficiency of the last pass.

16. A method in accordance with claim 14 wherein said step for establishing said first signal representative of the desired flow rate of said air stream in response to the calculated efficiency of said furnace comprises the steps of:

establishing an air flow set point signal responsive to the calculated efficiency of said furnace;

comparing the current efficiency to the efficiency of the last pass to determine if the current efficiency is greater than or less than the efficiency of the last pass; and modifying said air flow set point signal to establish said first signal, wherein said air flow set point signal is incremented or decremented responsive to the comparison of the current efficiency to the efficiency of the last past determined in said step for comparing the current efficiency to the efficiency of the last pass.

* * * * *